US005600849A

United States Patent [19]

Hu

[11] Patent Number: 5,600,849

[45] Date of Patent: Feb. 11, 1997

[54] WRIST GUARD

[76] Inventor: Antonio C. Hu, 960 Howard St., San Francisco, Calif. 94103

[21] Appl. No.: 499,451

[22] Filed: Jul. 7, 1995

[51] Int. Cl.[6] ..... A41D 13/08

[52] U.S. Cl. ..... 2/16; 2/161.1; 2/162

[58] Field of Search ..... 2/16, 162, 161.1; 473/61–63; 602/21, 64

[56] References Cited

U.S. PATENT DOCUMENTS

| | | | |
|---|---|---|---|
| 1,226,160 | 5/1917 | Allis | 473/62 X |
| 2,924,458 | 2/1960 | Barry | 2/16 X |
| 3,970,305 | 7/1976 | Hawkins | 473/62 |
| 4,088,318 | 5/1978 | Massman | 473/62 |
| 4,183,098 | 1/1980 | Knowles, Jr. | 2/16 |
| 4,677,971 | 7/1987 | Lindemann | 473/62 X |
| 4,719,906 | 1/1988 | DeProspero | 602/21 |
| 4,809,688 | 3/1989 | Aymerica del Valle | 602/21 |
| 4,854,310 | 8/1989 | Lee | 602/21 |
| 5,002,044 | 3/1991 | Carter | 602/21 X |
| 5,279,545 | 1/1994 | Reese, Sr. | 602/21 |
| 5,435,007 | 7/1995 | Kalvestran et al. | 2/16 |
| 5,492,331 | 2/1996 | Kawakami | 473/62 X |

FOREIGN PATENT DOCUMENTS

| | | | |
|---|---|---|---|
| 316379 | 11/1919 | Germany | 473/61 |

OTHER PUBLICATIONS

*Functional Wrist Splint,* The Journal of Bone and Joint Surgery, p. 224, Jan. 1956.

*A Splint For Fracture of the Carpal Navicular,* The Journal of Bone and Joint Surgery, pp. 922–924, Oct. 1942.

*Primary Examiner*—Paul C. Lewis

*Attorney, Agent, or Firm*—R. Craig Armstrong

[57] ABSTRACT

The wrist guard can be secured to the hand and wrist by a single strap, to provide protection to the hand and wrist. A rigid palm pad, removably attached to the guard over the palm, protects against impact and abrasion. A relatively stiff or substantially rigid support member is removably attached to the guard on the back of the hand and wrist to prevent backward flexion of the hand while permitting forward flexion. The hand and back of the wrist remain exposed for breathability. A flexible strap across the back of the forearm cushions the arm from the support during a fall. The support member includes a flexible rim across the top, across the back of the hand, to cushion the hand from the support during a fall. The guard is modular in nature such that the guard can be used without the support member when less protection is required or when less bulk and weight is desired. The palm pad and support member can be removed to facilitate cleaning of the guard. The guard can be worn with a wrist watch with the watch face visible to the user.

13 Claims, 4 Drawing Sheets

WRIST GUARD

BACKGROUND OF THE INVENTION

1. Field of the invention

This invention relates generally to guards and supports for the wrist and hand such as are used in sports.

2. Description of the Prior Art

Wrist injuries are the most common injuries in sports such as mountain biking, snow boarding, skateboarding, and especially in-line skating. When falling to the ground, participants in these sports will often extend their hands to break the fall. The weight of their falling bodies places an enormous amount of force on the wrists, often resulting in hyperextension, sprains, or fractures. A number of protective devices have been disclosed which are intended to prevent or reduce the likelihood of injury to the wrist.

Current wrist guards generally consist of two plastic splints constrained tightly above and below the wrist by a fabric sleeve with three adjustable straps. The splints and fabric sleeve extend from the forearm to the hand and serve to fix the wrist at an angle of 20 degrees. Existing wrist guards are very uncomfortable to wear. They do not permit downward flexion of the wrist, place pressure on bones in the hand and wrist, are hot, do not breathe well, and are difficult to wear and to remove.

A number of such protective devices, which are intended to prevent injury to the wrist, have been disclosed in various United States patents.

U.S. Pat. No. 4,138,108 to Robinson discloses a hand/wrist brace designed to restrain forward or rearward flexing of the wrist while bowling. Flexible material is used to secure stiffening members on the front and back of the hand and wrist. Nearly all wrist guards for in-line skating and skateboarding on the market conform to this design.

U.S. Pat. No. 5,279,545 to Reese is for a wrist brace designed to limit the range of motion of the user's wrist during rehabilitation from injury. It consists of a rigid forearm member hingeably secured to a rigid hand member. The desired range of motion is adjusted by straps on either side of the brace. While appropriate for rehabilitation of injuries, this design would not be effective in preventing hyperextension and would be too bulky for active use in sports.

U.S. Pat. No. 5,170,508 to Kawada described a golf glove with a binding band which prevents the hand and thumb from bending backward.

U.S. Pat. No. 5,014,689 to Meunchen and Durkin is for a flexible hand brace intended to control carpal tunnel syndrome by limiting hand extension and flexion.

U.S. Pat. No. 4,854,310 to Lee discloses a splint having a rigid sheet, a rigid collar, and a retaining strap designed to immobilize part of a limb. The sheet is perforated to allow ventilation and cleaning of the limb.

U.S. Pat. No. 4,479,678 to Alivo is for a bowler's wrist brace comprising rigid members secured to the front and back of the hand and wrist by straps.

U.S. Pat. No. 4,400,829 to Willis is a football glove which provides protection for the back of the hand and back of the wrist.

U.S. Pat. No. 4,183,098 to Knowles describes a bowler's wrist support which prevents backward flexion of the wrist while allowing forward flexion via a series of rigid plates hingeably attached to one another along the back of the hand.

U.S. Pat. No. 3,238,939 to Stubbs discloses a wrist support consisting of a flexible band designed to brace but not lock the wrist.

Rollerblade has a wrist guard which also prevents backward bending of the hand while allowing forward bending. The design incorporates a semi-rigid plastic plate with a number of living hinges which allow bending in one direction and which lock at a predetermined angle in the other direction.

While some of the inventions referenced above are effective in preventing wrist hyperextension, they are generally uncomfortable to wear. Many devices constrain the wrist too tightly, so that they restrict both forward and rearward flexion, even though forward flexion is often desirable. The restriction on movement of the wrist also makes these devices uncomfortable to wear. The devices are often hot and sweaty to wear because the material and stiffening members prevent the circulation of air around the hand and wrist. Some devices are also difficult to put on and remove because they require the fastening or unfastening of up to three straps. Some inventions which incorporate a rigid stiffening member on the back of the hand and wrist cause pain when backward pressure is placed on the hand. None of the referenced disclosures combine the degree of forward wrist flexion, breathability, ease of use, and comfort of the present invention.

SUMMARY OF THE INVENTION

It is an object of the invention to provide an improved wrist guard which is more comfortable to wear, permits downward flexion of the wrist, reduces pressure on the bones, is cool to wear, is very breathable, and is easy to wear and to remove.

In the invention, the guard reduces the likelihood of injuries such as abrasion and hyperextension due to falling. The guard has a support member which has a first element configured to rest along the back of a person's hand, a second element configured to rest along the back of the person's forearm near the wrist, and relatively stiff third and fourth elements which connect the first and second elements. The third and fourth elements are configured for location on right and left sides of the wrist, respectively, leaving the back of the wrist substantially exposed. Means are provided for detachably securing the support member to the wrist.

Preferably, the second element is a strap extending between the third and fourth elements.

Preferably, the means for detachably securing the support member to the wrist includes at least a partial glove, the support member being secured thereto.

Preferably, there is an abrasion pad configured to rest against the person's palm, the wrist guard including means for detachably securing the abrasion pad against the person's palm.

Preferably, the support member is detachably secured to the glove or partial glove, by third and fourth elements being passed through loops extending from the glove, and the abrasion pad is detachably secured by proximate and distal ends thereof being inserted in respective pockets in the glove.

The preferred embodiment of the invention can be secured to the hand and wrist by a single strap. The palm pad protects against impact and abrasion. The support member prevents backward flexion of the hand while permitting forward flexion. The hand and back of the wrist remain exposed for breathability. The flexible strap across the back of the forearm cushions the arm from the rigid support during a fall. The support member includes a flexible rim across the top, across the back of the hand, to cushion the hand from the rigid support during a fall. The guard is modular in nature such that the guard can be used without the support member when less protection is required or when less bulk and weight is desired. The palm pad and support member can be removed to facilitate cleaning of the guard. The guard can be worn with a wrist watch with the watch face visible to the user.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
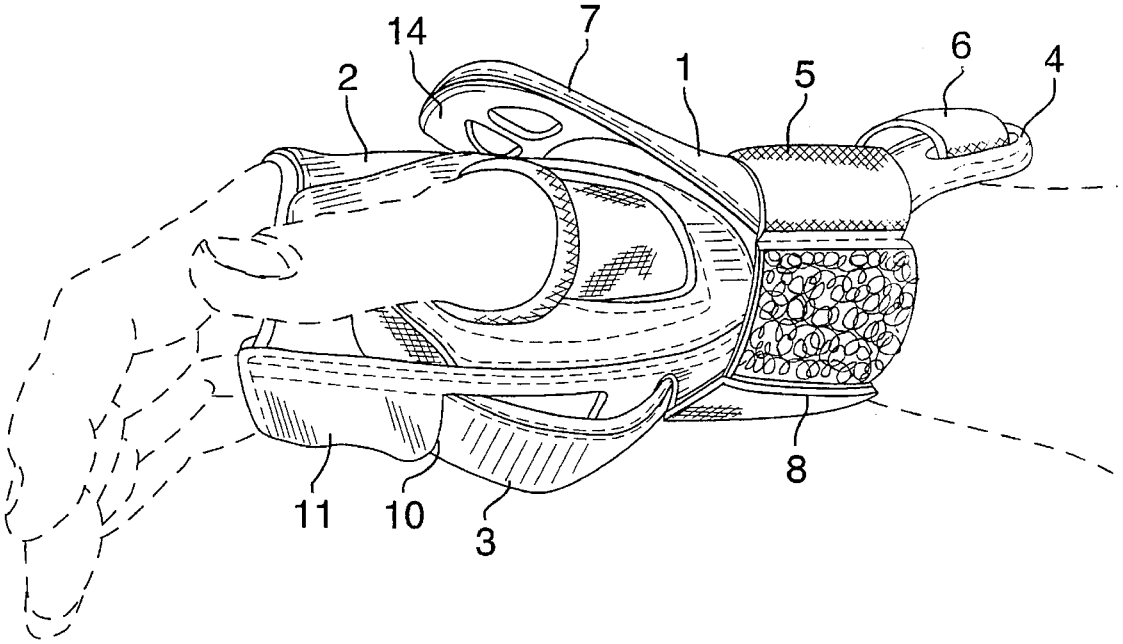
FIG. 1 is a perspective view of the wrist guard on a person's hand.
Figure 2:
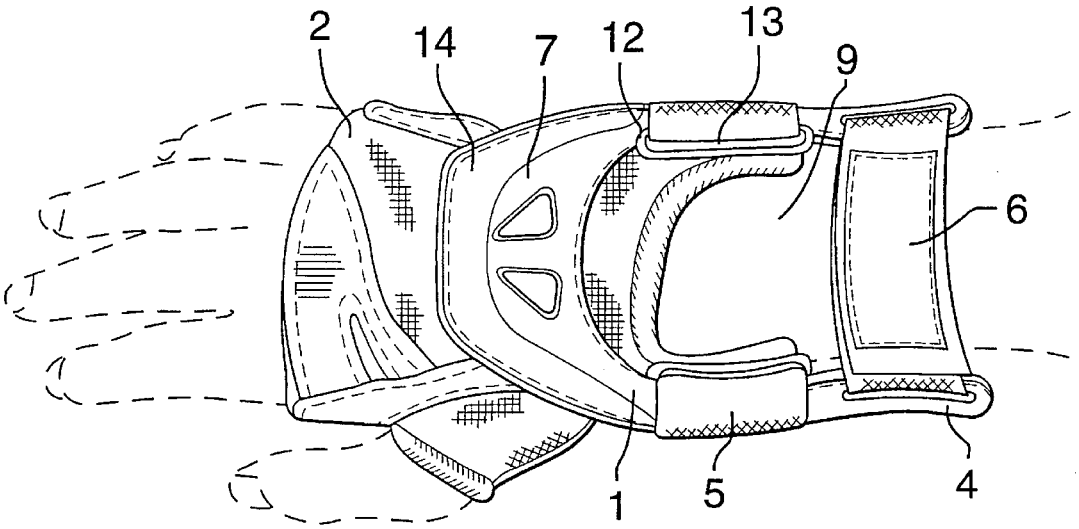
FIG. 2 is a top view of the wrist guard.
Figure 3:
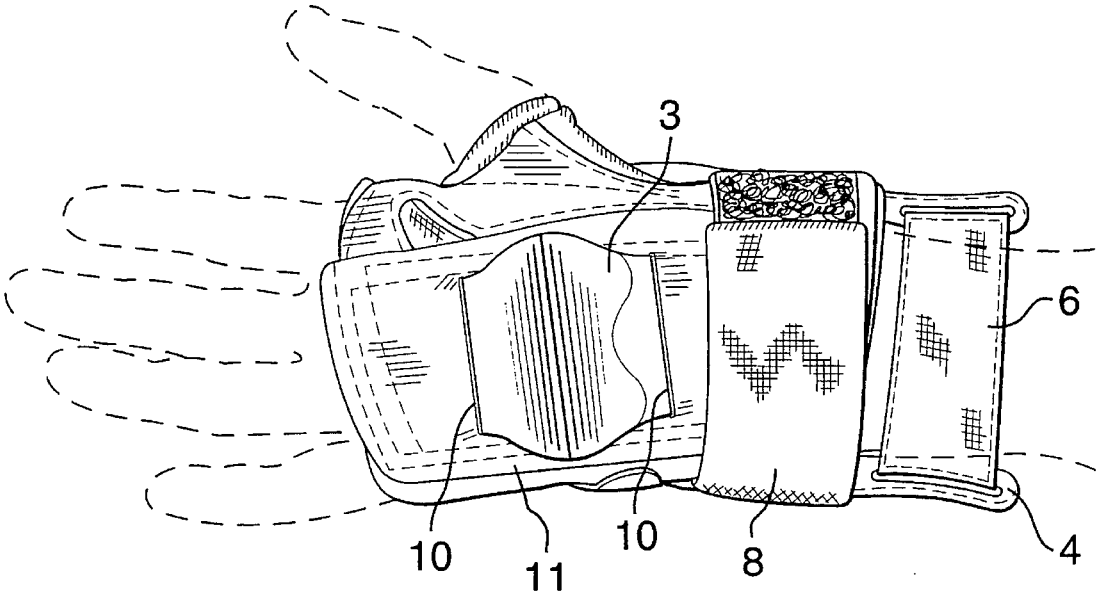
FIG. 3 is a bottom or palm-side view of the wrist guard.
Figure 4:
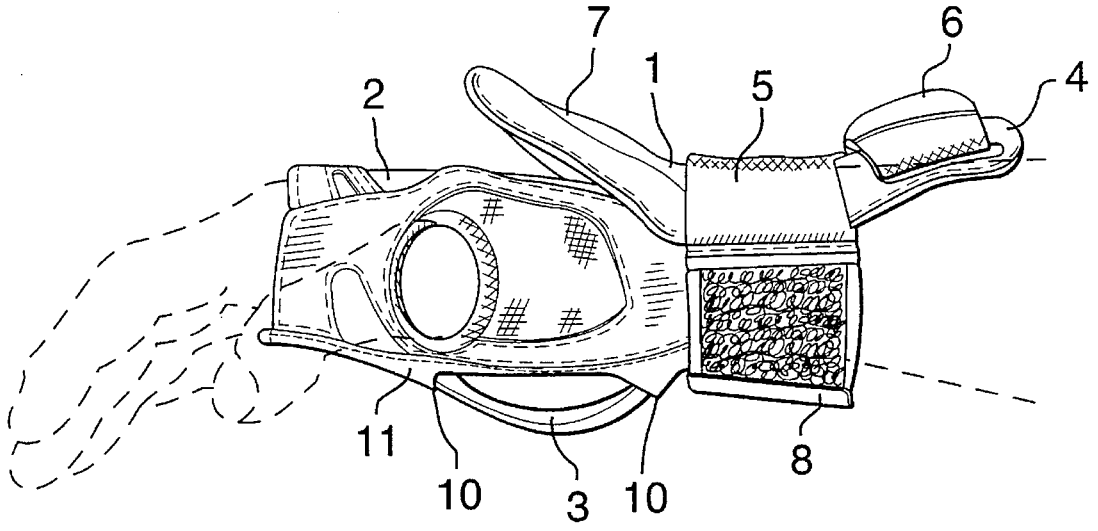
FIG. 4 is a side view of the wrist guard.
Figure 5:
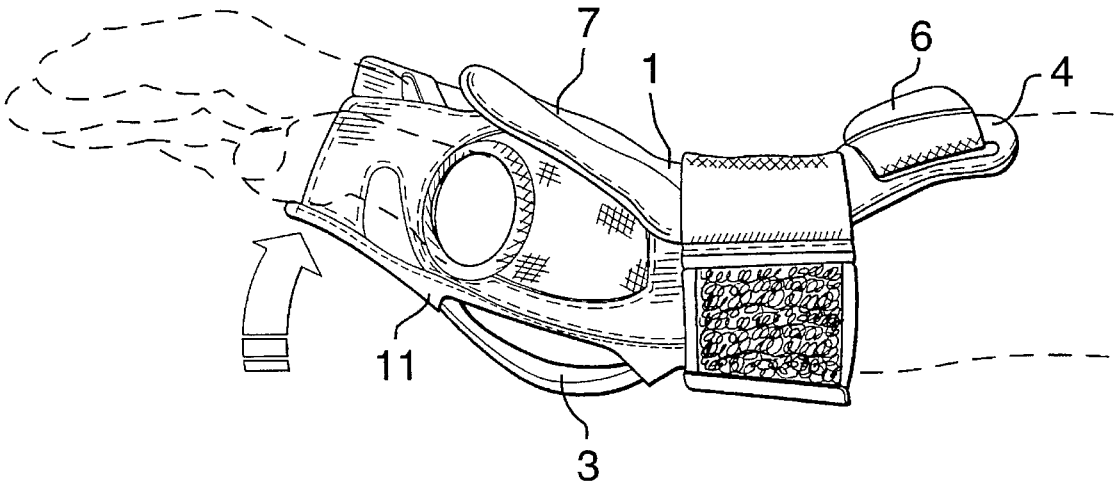
FIG. 5 is another side view, with the wrist extended.
Figure 6:
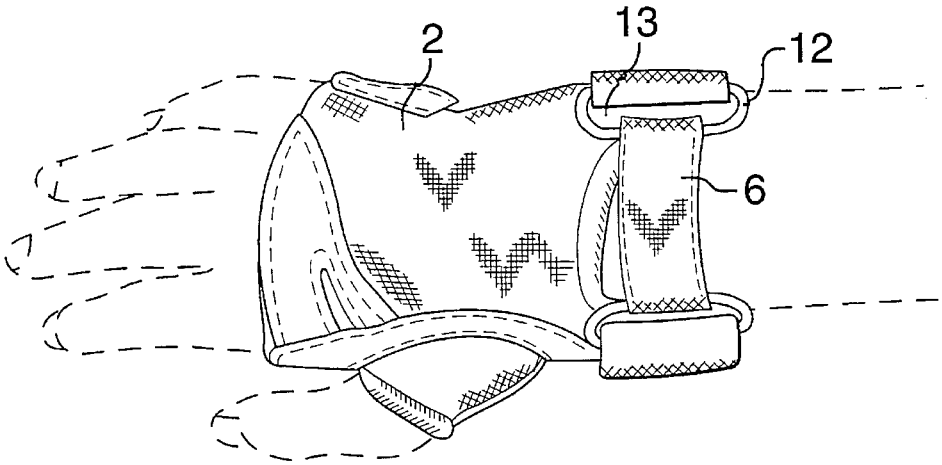
FIG. 6 is a top view of the wrist guard, with the support member removed.
Figure 7:
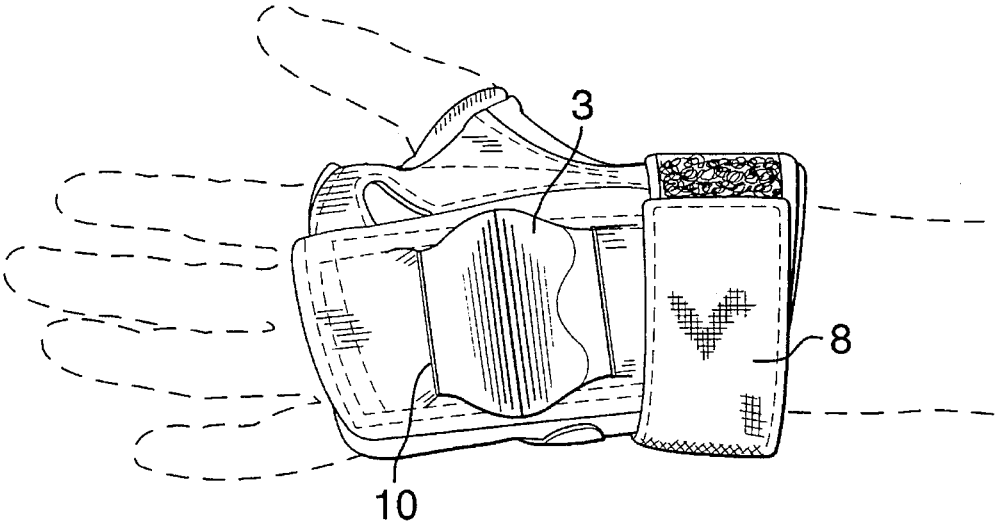
FIG. 7 is a bottom or palm view with the support member removed.
Figure 8:
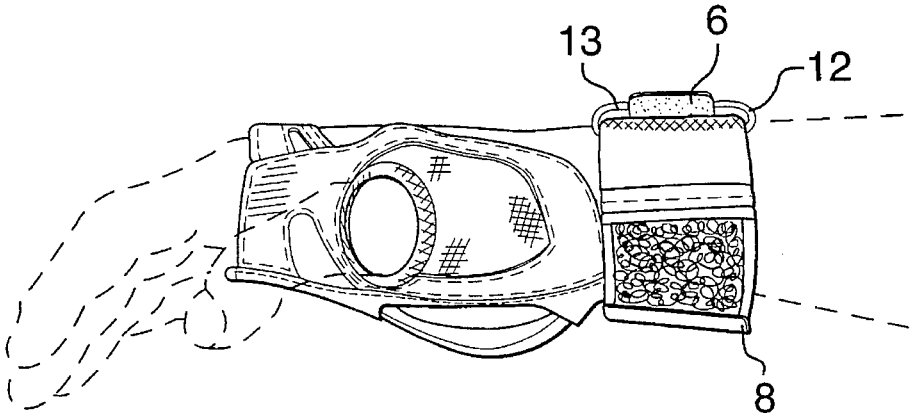
FIG. 8 is a side view with the support member removed.

The preferred embodiment of the wrist guard has a wrist support member 1, a half-glove 2, and an abrasion pad 3. In the preferred embodiment, the wrist support is attached to the glove by inserting the stays 4 through loops 5 on either side of the glove. A strap 6 is then attached to the ends of the stays to secure the wrist support to the glove. The abrasion pad covers only the palm area and is removably attached to the glove.

The support member 1 includes a first element 7 which is configured to rest along the back of a person's hand and which may or may not be substantially rigid, a second element such as the strap 6 which is configured to rest along the back of the person's forearm near the wrist, and relatively stiff or substantially rigid third and fourth elements such as the stays 4 which connect the first and second elements, leaving the back of the wrist substantially exposed. Because the stays are designed to help prevent hyperextension of the wrist, they need to be relatively stiff. However, it may be advantageous for the stays to bend somewhat to prevent full transmission of the impact force to the forearm. Through application of beam bending theory, the stays' geometry, orientation and material composition may be adjusted to achieve the optimum characteristics.

The glove portion 2 of the wrist guard is comprised of an elastic, perforated piece of fabric (such as SPANDEX (trademark) mesh) reinforced by abrasion-resistant material (such as leather or synthetic leather) in key areas along the palm, the side of the hand, and the knuckles. Shock-absorbing material (such as foam) may be secured to the inside of the glove along the palm and around the wrist to aid in impact absorption and to cushion the hand and wrist against the rigid palm pad and support member. In the preferred embodiment, the glove is fingerless, permitting increased air circulation, although clearly the glove could be a whole glove instead of such a partial glove. The glove is adjustably, detachably attached around the wrist by a strap 8 with patches of hook and loop fastener (such as VELCRO (trademark)).

Preferably, the glove has a U-shaped opening 9 on the back of the wrist, which permits a watch to be worn with the face of the watch being visible.

A rigid, preferably plastic, palm pad is removably attached to the palm of the glove by sliding the top and bottom of the palm pad into slots or pockets 10 cut into the abrasion-resistant material 11 along the palm of the glove. The palm pad is attached sufficiently tightly to withstand the force of repeated impacts due to falling. The palm pad is curved slightly away from the palm, and the abrasion-resistant material has an opening located beneath the palm pad, to facilitate airflow to the hand.

The relatively stiff or substantially rigid, preferably plastic, support member 1 is removably attached to the glove by two loops 5 formed by straps located on either side of the glove. A cord 12 is fastened at each loop location, to define secondary loops 13. The support member is secured in place by a flexible strap which passes through two slots on either arm or stay of the support member. The flexible strap is fastened to itself by means of hook and loop fasteners. The strap includes a layer of shock-absorbing material on the side adjacent to the user's forearm. When the glove is worn without the support member, the flexible strap is attached to the glove by passing the strap through the two cords fastened around the two loops located on either side of the glove. Preferably the rim 14 of the support member is somewhat flexible, to minimize the impact on the back of the hand as hyperextension of the wrist is being prevented.

When the invention is in use, the loops 5 act as a pivot point for the wrist support. When the hand extends backwards, the front 7 of the wrist support moves up and back, forcing the wrist support strap down against the forearm. The wrist support thereby prevents hyperextension of the wrist.

The use of the small abrasion pad and the pivot loops allows the wrist to flex freely downward.

Unlike existing wrist guards which sandwich the wrist between plastic splints, this invention places little pressure on the hand and wrist.

The configuration of the wrist support, with the stays running along the sides of the wrist, permits much more air circulation around the hand than existing wrist guards. The use of a half-glove also contributes to breathability.

With the wrist support attached to the glove, as the means for detachably securing the support member to the wrist, there remains only one strap 8 to operate for wearing or removing the wrist guard. This is much simpler than the confusing array of three straps on most current wrist guards.

As additional features, the glove can be worn without the wrist support or without the abrasion pad when the additional protection is not necessary, and the wrist support and abrasion pad can be removed for easy washing of the glove.

It will be appreciated that the above description related to the preferred embodiment by way of example only. Many variations on the invention will be obvious to those knowledgeable in the field, and such obvious variations are within the scope of the invention as described and claimed, whether or not expressly described.

What is claimed as the invention is:

1. A wrist guard for inline skating or the like, configured for wearing by a person, comprising:

a glove element having palm and back portions respectively covering at least the palm and a substantial portion of the back of the person's hand;

a support member secured to said glove element to overlie said back portion and extend rearwardly along the back side of the person's wrist, said support member comprising a first element configured to rest against the back of the person's hand, a second element configured to rest against the back of the person's wrist, and rigid third and fourth elements connecting said first and second elements to restrict backward flexion of the band, said third and fourth elements being configured to extend along right and left sides of the wrist, respectively, so as to leave the back of the wrist substantially uncovered, thereby facilitating viewing of a wristwatch if one is worn by the person.

2. A wrist guard as recited in claim 1, where said first element is substantially rigid, where said first, third and fourth elements are integral, generally defining a U-shape, said second element extending between said third and fourth elements.

3. A wrist guard as recited in claim 2, wherein said second element is a strap extending between said third and fourth elements.

4. A wrist guard as recited in claim 1, where said support member is detachable from said glove element.

5. A wrist guard as recited in claim 1, further comprising a substantially rigid abrasion pad secured to said glove element to overlie said palm portion.

6. A wrist as recited in claim 5, where said abrasion pad is detachable from said glove element.

7. A wrist guard as recited in claim 5, where said support member and said abrasion pad are detachable from said glove element.

8. A wrist guard for inline skating or the like, configured for wearing by a person, comprising:

a support member positionable to overlie the back of the person's hand and extend rearwardly along the back of the person's wrist, said support member comprising a first element configured to rest against the back of the person's hand, a second element configured to rest against the back of the person's wrist, and rigid third and fourth elements connecting said first and second elements to restrict backward flexion of the hand;

a substantially rigid abrasion pad positionable to overlie the person's palm; and means for securing said support member to overlie the back of the person's hand and extend rearwardly along the back of the person's wrist and said rigid abrasion pad to overlie the person's palm;

said third and fourth elements being configured to extend along right and left sides of the wrist, respectively, so as to leave the back of the wrist substantially uncovered, thereby facilitating viewing of a wristwatch if one is worn by the person.

9. A wrist guard as recited in claim 8, where said first element is substantially rigid, where said first, third and fourth elements are integral, generally defining a U-shape, said second element extending between said third and fourth elements.

10. A wrist guard as recited in claim 9, wherein said second element is a strap extending between said third and fourth elements.

11. A wrist guard as recited in claim 8, where said support member and said abrasion pad are detachable from said means for securing.

12. A wrist guard as recited in claim 8, where said means for securing said support member and said rigid abrasion pad to overlie the person's palm comprises a glove element having palm and back portions respectively covering at least the palm and a substantial portion of the back of the person's hand.

13. A wrist guard as recited in claim 12, where said support member and said abrasion pad are detachable from said glove element.

* * * * *